US010830431B2

(12) United States Patent
Yu

(10) Patent No.: US 10,830,431 B2
(45) Date of Patent: Nov. 10, 2020

(54) ONCE THROUGH STEAM GENERATOR WITH 100% QUALITY STEAM OUTPUT

(71) Applicant: Canada J-R Consulting Inc., Calgary (CA)

(72) Inventor: Jinjun Yu, Calgary (CA)

(73) Assignee: Canada J-R Consulting Inc., Calgary (CA)

( * ) Notice: Subject to any disclaimer, the term of this patent is extended or adjusted under 35 U.S.C. 154(b) by 297 days.

(21) Appl. No.: 15/674,207

(22) Filed: Aug. 10, 2017

(65) Prior Publication Data

US 2019/0049104 A1 Feb. 14, 2019

(51) Int. Cl.

| | |
|---|---|
| ***F22B 29/06*** | (2006.01) |
| ***F22B 37/48*** | (2006.01) |
| ***F22G 1/02*** | (2006.01) |
| ***F22B 37/26*** | (2006.01) |
| ***F22G 5/12*** | (2006.01) |
| ***F22B 1/22*** | (2006.01) |
| ***F22B 37/32*** | (2006.01) |

(52) U.S. Cl.

CPC ..... *F22B 29/06* (2013.01); *F22B 1/22* (2013.01); *F22B 29/064* (2013.01); *F22B 37/26* (2013.01); *F22B 37/265* (2013.01); *F22B 37/32* (2013.01); *F22B 37/486* (2013.01); *F22G 1/02* (2013.01); *F22G 5/123* (2013.01)

(58) Field of Classification Search

CPC ..... F22B 1/22; F22B 29/06; F22B 29/064; F22B 37/26; F22B 37/265; F22B 37/32; F22B 37/486; F22G 1/02; F22G 5/123

USPC ..... 122/406.4

See application file for complete search history.

(56) References Cited

U.S. PATENT DOCUMENTS

| | | | | |
|---|---|---|---|---|
| 2,661,075 | A * | 12/1953 | Brister | F22B 37/265 96/245 |
| 2007/0034550 | A1* | 2/2007 | Hedrick | C10G 11/00 208/113 |
| 2010/0043433 | A1* | 2/2010 | Kelly | F28D 9/0006 60/641.2 |
| 2012/0193093 | A1* | 8/2012 | James | E21B 43/2406 166/267 |
| 2012/0312522 | A1* | 12/2012 | Quin | G01F 1/667 166/53 |

(Continued)

*Primary Examiner* — Steven B McAllister
*Assistant Examiner* — Benjamin W Johnson
(74) *Attorney, Agent, or Firm* — Kyle R Satterthwaite; Ryan W Dupuis; Ade & Company Inc

(57) ABSTRACT

A system for deriving 100% quality steam for steam assisted gravity drainage (SAGD) injection or other applications features a once through steam generator (OTSG), a steam-water separator connected downstream of the OTSG's radiant tubes to separate steam and water from a two-phase flow received therefrom, superheater tubes installed in the convection section and connected to a steam outlet of the steam-water separator in downstream relation thereto to receive and heat dried steam therefrom to a superheated state, and a desuperheater connected downstream of the superheater tubes to receive the superheated steam therefrom and use same to vaporize blowdown water from the steam-water separator, whereby the vaporized blowdown water and the superheated steam collectively form a superheated steam output for the intended application, typically after additional separation of solid particles therefrom for optimal steam quality.

12 Claims, 3 Drawing Sheets

(56) References Cited

U.S. PATENT DOCUMENTS

2014/0151908 A1* 6/2014 Forslund ..... F22G 5/12
261/160

* cited by examiner

ONCE THROUGH STEAM GENERATOR WITH 100% QUALITY STEAM OUTPUT

FIELD OF THE INVENTION

The present invention relates generally to once through steam generators (OTSGs), such as those used for Steam Assisted Gravity Drain (SAGD) in heavy oil or bitumen production, and more particularly to OTSGs wherein initial two-phase steam-water flow from the OTSG is separated so that the separated steam can be superheated and then used to vaporize blowdown from the separator.

BACKGROUND

It is well known that traditional OTSGs design for SAGD is limited to roughly 80% steam quality at the OTSG's outlet, and because of high TDS (total dissolved solid) content in BFW (boiler feed water), the TDS content after evaporation of the BFW in the radiant section will be concentrated 5 times when the steam quality has reached 80%. From many past years of OTSG operation experience, it is known that any steam quality higher than 80% will tend to cause severe deposition on inside surfaces of the OTSG tubes, which will result in overheating and eventual rupture of the tube walls. So in conventional designs, 20% blowdown water has to be wasted, i.e. cannot be used to generate steam.

U.S. Patent Application Publication No. 2014/0305645 discloses an OTSG where the amount of blowdown is reduced by separating the initial two-phase OTSG output into separate steam and water flows, passing the separated steam through a superheater, and then mixing the superheated steam with the blowdown from the separator to evaporate some of the blowdown, thereby converting more overall water to steam.

However, there remains room for further improvement, and Applicant has developed a unique OTSG design with further improvements not foreseen by the prior art.

SUMMARY OF THE INVENTION

According to a first aspect of the invention, there is provided a system for deriving superheated steam for steam assisted gravity drainage (SAGD) injection or other application, said system comprising:

a once through steam generator (OTSG) comprising:

a burner operable to generate a flue gas;

a radiant section containing furnace tubes that are exposed to radiant flame heat of the burner;

a convection section having a flue gas inlet for admission of said flue gas from said radiant section into said convection section for travel therethrough in a flue gas pathway to an opposing flue gas outlet, and convection tubes situated between said flue gas inlet and said flue gas outlet in fluid communication with the flue gas pathway for exposure of said convection tubes to said flue gas travelling therethrough, an upstream end of said convection tubes being connected to a feed water inlet and a downstream end of said convection tubes being connected to the furnace tubes, whereby a feed water stream flowing through said convection and furnace tubes undergoes partial conversion to steam;

a steam-water separator connected to said radiant tubes in downstream relation thereto to receive a two-phase steam-water flow resulting from said partial conversion of the feed water stream, and perform separation of said two-phase steam-water flow into blowdown water and dried steam;

superheater tubes installed in said convection section in fluid communication with the flue gas pathway for exposure to said flue gas travelling therethrough, said superheater tubes being connected to a steam outlet of said steam-water separator in downstream relation thereto to receive the dried steam and convert the dried steam to superheated steam using the heat of the flue gas; and a desuperheater connected to the superheater tubes in downstream relation thereto to receive the superheated steam therefrom at a steam inlet of said desuperheater, and also connected to a blowdown outlet of said steam-water separator to receive the blowdown water therefrom, the desuperheater being configured to vaporize said blowdown water using the superheated steam from the superheater tubes to generate a superheated steam output from said desuperheater for use by the SAGD injection or other application.

Preferably a steam-particle separator is connected to an outlet of the desuperheater to receive the superheated steam output therefrom and remove solid particles therefrom and thereby achieve improved steam quality in the superheated steam output of said desuperheater before use in the SAGD injection or other application.

Preferably steam-particle separator has a solids disposal outlet through which solid particles are dispensed after separation from the superheated steam output of the desuperheater, and in one embodiment the solids disposal outlet feeds a disposal conduit that is at least partially submerged in a fluid for cooling of said solids during travel thereof through submerged portions of said disposal conduit.

Preferably the convection tubes comprise a first and second sets of convection tubes located respectively adjacent the flue gas outlet and the flue gas inlet of the convection section, and the superheater tubes are situated intermediately between said first and second sets of convection tubes in a flow direction of the flue gas pathway.

Preferably the first set of convection tubes are situated upstream of the second set of convection tubes in relation to a direction of feed water flow through the convection tubes from the feed water inlet.

Preferably the steam-water separator is a multi-stage separator for achieving a substantially dry steam.

Preferably the multi-stage separator comprises a vessel with a primary cyclone separation stage and a secondary separation stage of chevron scrubbers mounted in an upper internal area of said vessel.

Preferably the desuperheater comprises internal surface areas having a protective coating thereon to prevent disposition of solids on said surfaces.

Preferably the desuperheater comprises an internal thermal sleeve obstructing outer walls of the desuperheater from exposure to the superheated steam and water droplets carried thereby, said protective coating being disposed on an interior surface of said internal thermal sleeve.

Preferably said protective coating is a non-stick coating.

Preferably said protective coating is a ceramic coating.

Preferably the desuperheater is a Venturi-type desuperheater.

Preferably the Venturi-type desuperheater is configured to provide a through-speed of between 70 m/s and 120 m/s at a Venturi throat of said desuperheater. Spray water speed is preferably around 1 m/s.

In one embodiment, a solids disposition remover is operably arranged with the desuperheater to remove deposited solids from internal surfaces thereof.

Preferably the solids disposition remover is an ultrasonic solids disposition remover.

According to a second aspect of the invention, there is provided a desuperheater comprising:

an outer housing having a water inlet for introducing an incoming supply of water, a superheated steam inlet for introducing an incoming supply of superheated steam for use in vaporization of said water, and an outlet from which the superheated steam and vaporized water are emitted;

a thermal sleeve disposed inside said outer housing to obstruct inner surfaces of a circumferential wall of said housing from exposure to the superheated steam and vaporized water moving through the housing; and a protective coating on an interior surface of said thermal sleeve to prevent disposition of solids on said interior of the thermal sleeve.

According to a third aspect of the invention, there is provided a desuperheater apparatus comprising:

a housing having a water inlet for introducing an incoming supply of water, a superheated steam inlet for introducing an incoming supply of superheated steam for use in vaporization of said water, and an outlet from which the superheated steam and vaporized water are emitted; and a solids disposition remover operably arranged with the desuperheater to remove deposited solids from internal surfaces inside said housing.

BRIEF DESCRIPTION OF THE DRAWINGS

One embodiment of the invention will now be described in conjunction with the accompanying drawings in which.

DETAILED DESCRIPTION

Figure 1:
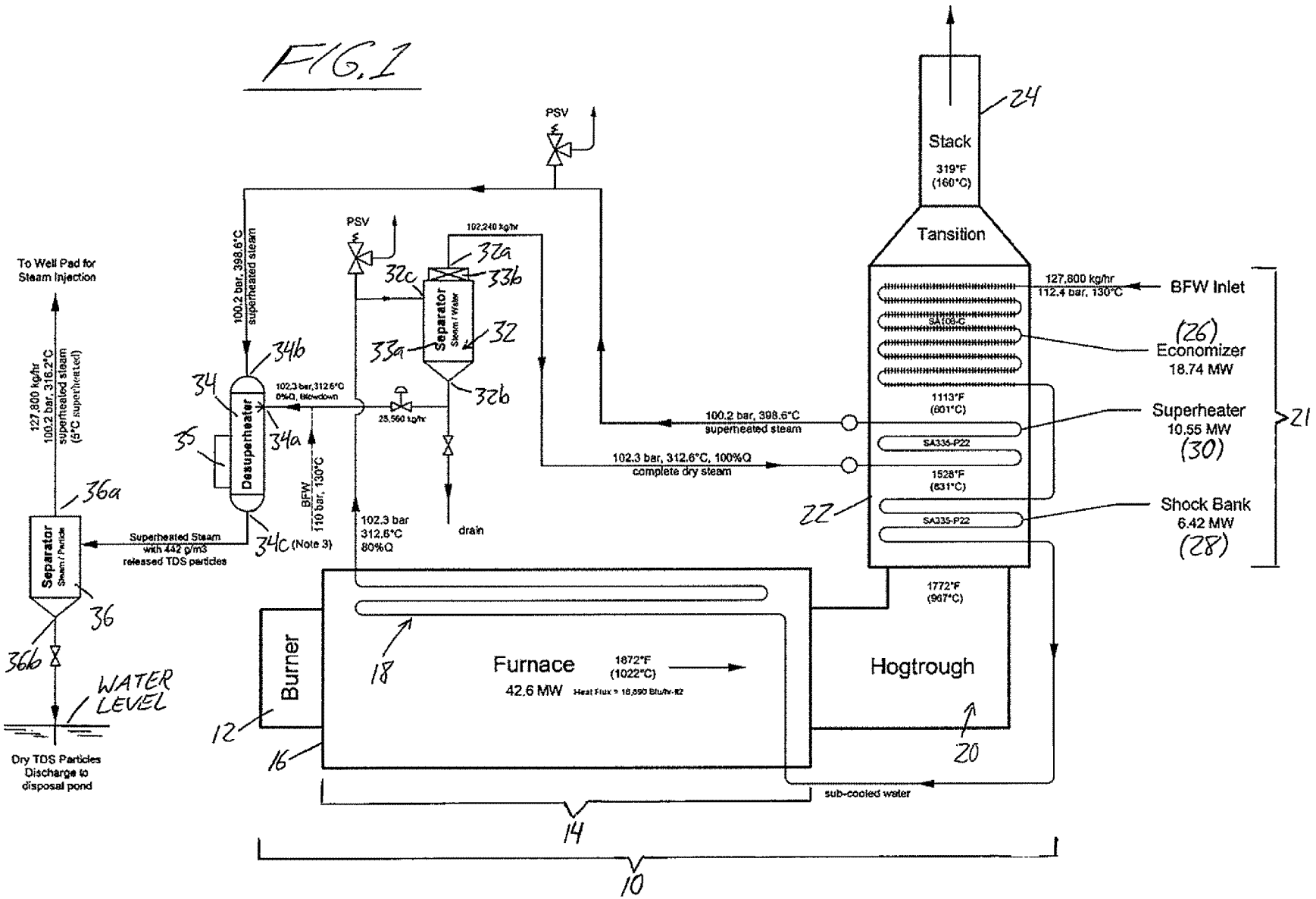
FIG. 1 is a schematic illustration of an OTSG system for generating 100% quality steam for use in steam assisted gravity drainage (SAGD) heavy-oil/bitumen recovery or other steam-requiring applications.

FIG. 1 shows an OTSG 10 which features a burner 12, a radiant section 14 featuring a horizontally oriented housing 16 containing a plurality of furnace tubes 18 placed therein for exposure to radiant flame heat from the burner 12, a hogtrough section 20 receiving flue gas from the radiant section and directing the flue gas therefrom into a subsequent convection section 21. The convection section a vertically upright housing 22 containing sets of convection tubes therein in order to enable heat transfer from the flue gas into fluids passing through the convection tubes. The hogtrough feeds a flue gas inlet of the convection section at the lower end of the upright housing 22, and a flue stack 24 standing upright from the top end of the upright housing 22 defines a flue gas outlet of the convection section. The interior of the upright housing 22 between the flue gas inlet and the flue gas outlet stack 24 defines a flue-gas pathway by which the flue gas passes through the convection section in an upward travel direction.

The convection tubes within the upright housing includes a first set of tubes 26 (e.g. SA106-C tubes) that are situated adjacent the top end of the upright housing near the flue gas outlet and are fed by a boiler feed water (BFW) inlet, and a second set of tubes 28 (e.g. SA335-P22 tubes) that are situated adjacent the bottom end of the upright housing near the flue gas inlet and are connected in series with the first set of tubes in downstream relation thereto relative to the BFW inlet. While downstream from the first set of tubes in relation to the flow direction of feed water from the BFW inlet, the second set of tubes reside in upstream relation to the first set of tubes relative to the flue gas's travel direction through the upright housing of the convection section. The first set of tubes thus define an economizer of the convection section, while the second set of tubes define a shock bank exposed to the greatest heat of the flue gas at the flue gas inlet of the convection section.

The convection tubes in heat exchange relation with the flue gas in the upright housing of the convection section also include a third set of tubes 30 (e.g. SA-335-P22 tubes) that are located intermediately between the economizer tubes 26 and the shock bank tubes 28 in the flue gas pathway. However, this third set of tubes 30 is not connected in series between these other two sets of convection tubes. Instead, while still in the same fluid circuit fed by the BFW inlet, the third set of convection tubes are fed from a location situated further downstream this circuit and serve as a superheater for heating dried steam received in this third set of tubes, as described in more detail further below.

Residing in the same fluid circuit at a location downstream of the shock bank tubes 28 and upstream of the superheater tubes 30 are the furnace tubes 18, from which the fluid circuit then feeds into a steam-water separator 32. A steam outlet 32*a* of the steam-water separator 32 feeds the superheater tubes 30 in the convection section. A desuperheater 34 is located further downstream of the steam-water separator 32 and the superheater 30 in the same fluid circuit. The desuperheater features a water inlet 34*a* that is fed by a blowdown outlet 32*b* of the steam-water separator, and a steam inlet 34*b* that is fed by the superheater tubes 30. Downstream of the desuperheater 34 in the same fluid circuit is a steam-particle separator 36 that is fed by an outlet 34*c* of the desuperheater. A steam outlet 36*a* of the steam-particle separator 36 leads to steam injection equipment at the well pad of a SAGD heavy-oil/bitumen recovery operation. A solids disposal outlet 36*b* of the steam-particle separator 36 leads to a disposal pond or other disposal site. Use of a disposal pond as the final release point for dry TDS particles from the steam-particle separator provides for liquid based cooling of these particles after separation from the high temperature superheated steam.

Having described the general layout of the system, attention is now turned to its operation.

The feed water flows into the convection tubes 26, 28 and furnace tubes 18 from the BFW inlet, and like in a conventional OTSG, a substantial portion of the feed water is evaporated into steam by the heat from the flue gas in the convection section 21 and the radiant flame heat of the burner 12 in the radiant section 14, resulting in a two-phase water/steam flow of approximately 80% steam quality at the outlet of the furnace tubes 18. This two-phase flow is directed into the steam-water separator 32, which separates the two-phase flow into dried steam discharged through the steam outlet 32*a* and blowdown water drained through the blowdown outlet 32*b*. The water-steam separation is sufficiently thorough to provide completely or substantially dried steam of 100% or near 100% steam quality, and this dried steam is fed into the superheater tubes 30 of the convection section 21 for heating of the dried steam to a superheated level therein. This superheated steam from the superheater 30 is fed to the steam inlet 34*b* of the desuperheater 34, the other inlet 34*a* of which receives the blowdown water from the water-steam separator 32.

The incoming superheated steam at the desuperheater atomizes and vaporizes the incoming blowdown water so that the entire fluid output from the desuperheater at outlet 34*c* thereof is a single-phase stream of superheated steam. Since this single-phase stream of superheated steam output from the desuperheater will carry TDS particles released from the blowdown water during the vaporization thereof, this superheated steam output from the desuperheater is sent into the steam/particle separator 36 for separation of the TDS particles from the superheated steam. Dry TDS particles are discharged through the disposal outlet 36*b* of the steam-particle separator 36, while the steam outlet 36*a* thereof sends the resulting clean steam to the steam injection site of the SAGD heavy-oil/bitumen recovery operation. The purpose of the steam/particle separator is to remove particles in order to eliminate or minimize erosion of steam piping due to high speed particles hitting on the interior wall surface of the piping. The OTSG is typically located at a CPF (central process facility) plant, while the well pad at which the steam is injected is situated remotely from CPF, often by a significant distance, for example 10 km away. So while clean steam is not necessary for the injection process itself, where the steam will be mixed with bitumen or earth underground, the achievement of clean steam provides drastic benefit in reducing erosion of the lengthy run of steam pipes from the separator to the remote well pad location. While the result of 100% steam quality is therefore desirable for sourcing SAGD operations, the final high quality steam product of the system may additionally or alternatively be used for other applications.

Figure 3:
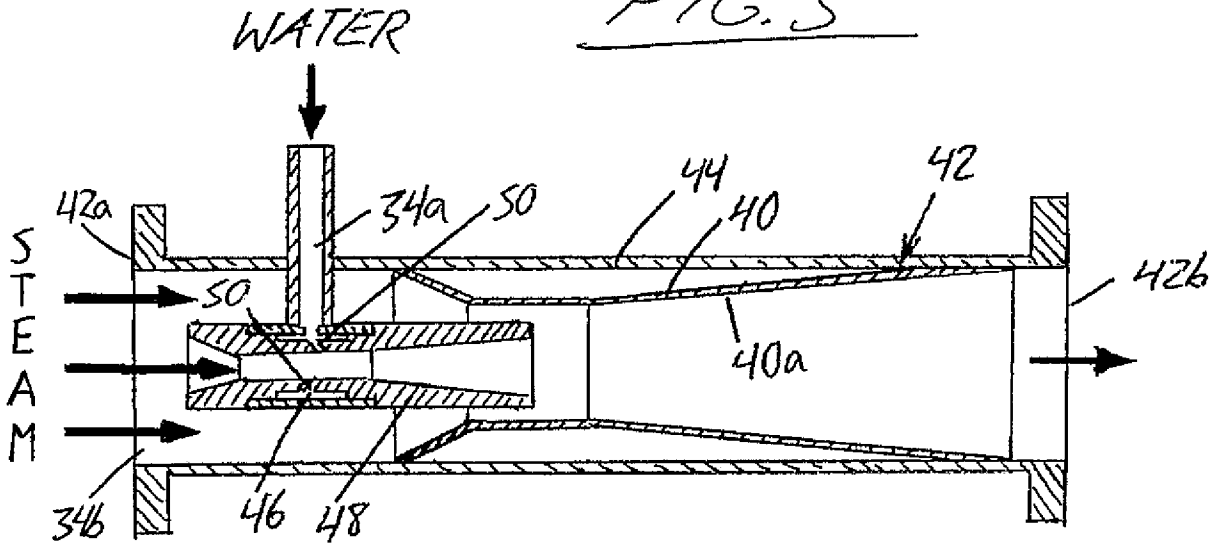
FIG. 3 is a schematic cross-sectional view of a desuperheater that is used to vaporize the blowdown water from the two-stage separator of FIG. 2 using the separated steam therefrom after passing said steam through a superheater of the OTSG.

FIG. 3 illustrates a desuperheater 34 particularly suited for the 100% quality steam generation system of the present invention. The desuperheater 32 is a Venturi-type desuperheater with a thermal sleeve 40 situated inside an outer housing 42 to obstruct substantial areas of the housing's circumferential wall 44 from the superheated steam and vaporized blowdown water moving through the housing to the outlet end 42*b* thereof. In a known manner, the water inlet 34*a* feeds into a circulatory chamber 46 around the constricted throat of an inner Venturi-tube 48 that is suspended centrally within the outer housing 42 near an inlet end 42*a* thereof that defines the steam inlet 34*b* of the desuperheater. Small jet ports 50 open from this chamber 46 into the throat of the inner Venturi-tube 48. The incoming blowdown water is pre-heated in the circulatory chamber 46 by the inner and outer streams of superheated steam passing through and around the inner Venturi-tube 48, and then atomized as it is fed by the jet ports 50 into the inner stream of superheated steam passing through the inner Venturi-tube 48. The fine mist of atomized water droplets are vaporized by the added heat from the superheated steam, and carried onward through the outlet end 42*b* of the housing, where the exiting stream of flow is now entirely superheated steam.

As shown, the thermal sleeve 40 forms a larger outer Venturi of the desuperheater, and the flared outlet of the inner Venturi-tube 48 reaches into the tapered inlet and constricted throat of the sleeve-formed outer Venturi. The desuperheater disclosed herein differs from known units of this type by the addition of a ceramic non-stick coating to the inner surface 40*a* of the thermal sleeve 40 to prevent disposition of solid particles thereon as the vaporization of the blowdown water releases TDS particles therefrom. The use of a Venturi-type desuperheater also helps reduce or avoid particle disposition on the interior thereof by accelerating the flow of superheated steam therethrough, for example to a preferable velocity in the range of 70 m/s to 120 m/s at the throat of the Venturi.

Figure 2:
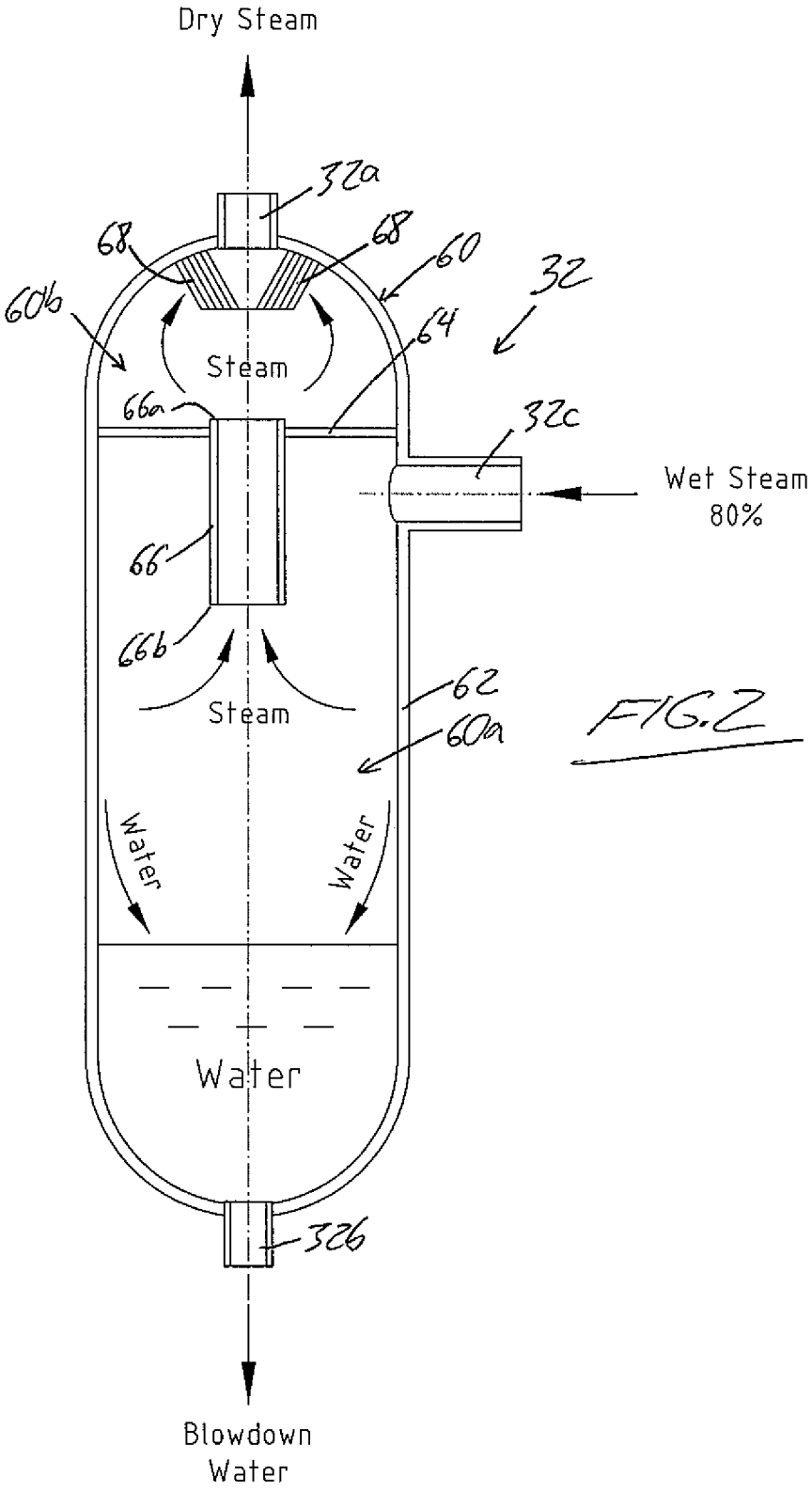
FIG. 2 is a schematic cross-sectional view of a two-stage steam-water separator used in the system of FIG. 1 to separate the steam water mixture from the OTSG into separate streams of dry steam and blowdown water.

To provide fully or substantially dried steam at the steam outlet 32*a* of the steam-water separator 32, the steam-water separator may be a multi-stage steam-water separator, for example an upright vessel separator 32 of the type shown in FIG. 2. The separator features an elongated vessel 60 whose central longitudinal axis lies in a vertical orientation, and which has a wet steam inlet 32*c* opening into the vessel 60 near, but spaced downward from, a top end of the vessel. The steam inlet opens into the vessel in a tangential direction relative to a cylindrical peripheral wall 62 of the vessel that closes around the vertical axis. The vessel interior is divided into a larger lower chamber 60*a* and a smaller upper chamber 60*b* by a horizontal baffle wall 64 situated above the wet steam inlet 32*c*. A riser pipe 66 has an upper end 66*a* communicating through an opening in the baffle wall 64, and an opposing lower end 66*b* situated at a spaced elevation below the wet steam inlet. The two-phase water-steam flow entering through the wet steam inlet 32*c* swirls around the lower chamber 60*a* of the vessel to perform a first stage of steam/water separation through cyclonic action. The water gravitates to the bottom of the vessel, where it is drained through the blowdown outlet 32*b*. The separated steam rises up through the riser pipe 66 into the upper chamber of the vessel, where chevron scrubbers 68 (or 33*b*) featuring layers of corrugated plates are positioned near the dry steam outlet 32*a* at the top end of the vessel so that the steam can only exit the vessel through the scrubbers. The scrubbers thus serve as a secondary stage of steam-water separation that supplements the primary stage of cyclonic separation in the lower chamber of the vessel. In FIG. 1, the primary and secondary stages of the two-stage steam-water separator are schematically represented at 33*a* and 33*b*.

In brief summary of the forgoing, compared to traditional OTSG layouts, the illustrated embodiment adds a steam-water separator at the OTSG outlet, sends the separated steam back to a superheater in the OTSG's convection section to produce superheated steam, while blowdown water from the steam-water separator is sent to a desuperheater, where the superheated steam is used to atomize/vaporize the blowdown water in desuperheater. In order to ensure the best final steam quality, the operating characteristics of the desuperheater are selected to ensure that the blowdown water is completely vaporized so that the entire output from the desuperheater is superheated steam.

In traditional OTSG designs used in SAGD environments, the separator is arranged at the OTSG outlet to separate the steam from the two phase output flow of the OTSG (typically 75-80% steam quality), and this separated steam is sent directly to the well pad for steam injection. Typically, such separator is in EPC scope of supply, and EPC (Engineering Procurement Construction) companies usually use one common separator for 4-5 OTSGs in order to save the capital cost. However, in embodiments of the present invention employing multiple OTSGs, a respective steam-water separator is preferably provided for each individual OTSG in order to simplify the superheater arrangement and enable independent operation of each OTSG.

The separated steam must be completely, or near-completely dry steam, because wet steam can cause deposition on inside surfaces of the superheater tubes, which can result in tube rupture. This need for dry steam is a new requirement relative to traditional separators used for OTSGs. To better ensure complete or near-complete dry steam (preferably >=99.9% steam quality), the preferred embodiment employs a two-stage separator, with a secondary separation stage added on top of the first stage separator, as shown in FIG. 2 where the secondary stage separator is situated inside the upper area of a vertical vessel in the form of one or more corrugated plate type (labyrinth) scrubbers.

The addition of the superheater to the traditional OTSG layout is required to further heat the separated saturated steam from steam/water separator, and produce superheated steam therefrom, for use in fully or substantially completed vaporization of blowdown water through the desuperheater in order to achieve 100% quality steam generation. For safety, the superheater is preferably arranged behind the shock bank (i.e. downstream thereof in the flue gas travel direction), whereby the superheater is within a lower temperature zone of the flue gas travel, since some of the initial heat from the flue gas has already been absorbed by the shock bank. That is, the shock bank is intentionally used to screen all radiant heat from the hogtrough, which is profitable for protection of superheater.

To obtain lower tube wall temperature, the superheater is preferably arranged in a co-current flow pattern. Per Applicant's calculations, rather than SA312-TP304, SA335-P22 may be an optimal tube material for the superheater, so as to save on capital costs for the OTSG's manufacture. In addition, SA335-P22 also has lower thermal expansion coefficient than SA312-TP304, which is also better for mechanical design. Use of the same outer diameter for the superheater tubes as the shock bank tubes may be preferable for ease and convenience.

The addition of the desuperheater to the traditional OTSG layout is significant in achieving 100% steam quality from the OTSG output. 20-25% blowdown water from the steam/water separator 32 can be vaporized completely through the desuperheater 34, which as mentioned above may be of the type similar to those conventionally used for power plant boilers. Preferably, a thermal sleeve 40 is inserted into the outer housing 42 of the desuperheater to prevent sprayed droplets of atomized water from hitting on desuperheater shell or circumferential wall of the housing, because the droplets will result in fatigue thermal stress, and eventually cause cracking of the shell if a protective sleeve is not inserted. To obtain quicker and complete vaporization, steam with 5-10° C. superheated degree is recommended at the desuperheater outlet. A Venturi-type desuperheater is recommended to get the best atomizing and vaporizing action, for example with a flow velocity of 70-120 m/s at the Venturi throat. Since, as stated above, the output from the desuperheater preferably still includes steam somewhat in the superheated range, it will be appreciated that the term desuperheater is being used to denote an apparatus receiving and mixing blowdown water and superheated steam, and thus may share structural features of known venturi-type desuperheaters, but is being used for the express purpose of performing the complete 100% vaporization of the inputted blowdown water, and not for the purpose of "desuperheating" the steam, i.e. cooling the superheated steam below the superheated range.

Due to expectation of high concentration of TDS in the blowdown water (approximate 35000-45000 ppm), deposition may be accumulated on thermal sleeve surface from sprayed droplets hitting on sleeve. However, with high velocity steam from the Venturi-accelerated flow, and some released TDS particles passing along the thermal sleeve's inner surface in the high velocity stream, the deposition on the sleeve may be scrubbed or removed by the particle-steam flow, and thus not present an ongoing concern. However, to better avoid deposition on the sleeve, the non-stick ceramic coating may be used on the sleeve's inner surface. A Teflon coating is not suitable, because the working temperature of the desuperheater exceeds the operational limits of such coating, whereas a ceramic coating can handle these significant temperatures. Thermolon ceramic coating is a suitable example, being capable of withstanding temperatures of 450° C. As an additional or alternative treatment for the potential deposition problem, an ultrasonic deposition remover (similar to an ultrasonic soot blower used on power plant boilers) may be used to remove deposition anywhere in desuperheater. An ultrasonic deposition remover is schematically illustrated in operable connection to the desuperheater at 35.

Theoretically, the injected steam in an SAGD operation does not necessarily need to be clean. However, per Applicant's calculations, the released TDS particle content in steam exiting the desuperheater may be extremely high, so, to eliminate erosion on the steam piping from the desuperheater to the well pad for steam injection, the steam-particle separator is added to remove these particles. The released TDS particle content in the steam from the desuperheater outlet is expected to be within 380-500 g/m$^3$, which is much higher than the usage of conventional separators for flue-gas/fly-ash, and the presently disclosed use of a steam-particle separation in a high pressure/temperature steam environment is unique. Because steam viscosity is much lower than air and flue gas, the separation efficiency shall be higher than the cyclonic separators typically used for separating flying-ash from flue gas. Per Applicant's calculated estimate, the released TDS particle size may be around 80-90 μm, which is based on 20% blowdown, 0.25 mm sprayed droplets, and 8000 ppm TDS in the boiler feed water. Per Applicant's CFD study, the particles that are greater than 10 μm can be 100% removed from steam, so the erosion on the piping from desuperheater outlet to the well pad or other target destination can be eliminated by the steam-particle separator, which may be a cyclonic separator. The separated TDS particles may be piped and discharged to an under-water destination surface in a disposal pond. Ball valves may be used as control valves to determine the final release point of the TDS particles in the pond via an at least partially submerged disposal conduit, e.g. under-water pipe. By routing the disposal conduit in at least partially submerged condition in the disposal pond, the hot TDS particles can be cooled by pond water through the wall of the underwater-pipe before reaching the ball valves, which therefore can use conventional low-cost valve seats (e.g. Teflon seats), as the liquid-cooled TDS particles will not exceed the temperature limits of such valve seats. On the other hand, ball valves with higher temperature tolerances may be used (e.g. metal seats capable of handling 500 degrees Celsius), though likely at greater cost, in which case submersion of the disposal conduit can optionally be omitted.

It will be appreciated that the term "desuperheater" is used herein not to denote that the output of the unit is no longer in a superheated state, as to the contrary, the output of the unit is superheated steam. Instead, the term is used in relation to the structural similarity of this component to desuperheaters (a.k.a. attemperators) conventionally used in the context of power plant boilers to provide temperature control. The application of such equipment in the context of the present invention to minimize blowdown and maximize steam quantity and quality is unique to best of Applicant's knowledge, as is the coating of the desuperheater's thermal sleeve with a non-stick coating, or the optional equipping of the desuperheater with an ultrasonic deposition remover.

FIG. 1 includes numerical values for several operating parameters of the system, which are presented only in an exemplary context, as the particular values of these parameters be varied from those shown in the drawings without departure from the overall scope of the present invention. Since these and other various modifications can be made in my invention as herein above described, and many apparently widely different embodiments of same made, it is intended that all matter contained in the accompanying specification and drawings shall be interpreted as illustrative only and not in a limiting sense.

The invention claimed is:

1. A system for deriving superheated steam for steam assisted gravity drainage (SAGD) injection or for another application, said system comprising:

a once through steam generator (OTSG) comprising:

a burner operable to generate a flue gas;

a radiant section containing furnace tubes that are exposed to radiant flame heat of the burner;

a convection section having a flue gas inlet for admission of said flue gas from said radiant section into said convection section for travel therethrough in a flue gas pathway to an opposing flue gas outlet, and convection tubes situated between said flue gas inlet and said flue gas outlet in fluid communication with the flue gas pathway for exposure of said convection tubes to said flue gas travelling therethrough, an upstream end of said convection tubes being connected to a feed water inlet and a downstream end of said convection tubes being connected to the furnace tubes, whereby a feed water stream flowing through said convection tubes and said furnace tubes undergoes partial conversion to steam;

a steam-water separator connected to said furnace tubes in downstream relation thereto to receive a two-phase steam-water flow resulting from said partial conversion of the feed water stream, and perform separation of said two-phase steam-water flow into blowdown water and dried steam;

superheater tubes installed in said convection section in fluid communication with the flue gas pathway for exposure to said flue gas travelling therethrough, said superheater tubes being connected to a steam outlet of said steam-water separator in downstream relation thereto to receive the dried steam and convert the dried steam to superheated steam using heat of the flue gas;

a desuperheater connected to the superheater tubes in downstream relation thereto to receive the superheated steam therefrom at a steam inlet of said desuperheater, and also connected to a blowdown outlet of the steam-water separator to receive the blowdown water therefrom, the desuperheater being configured to completely vaporize said blowdown water using the superheated steam from the superheater tubes to generate a superheated steam output having a solids particle content that measures between 380 and 500 g/m$^3$ in particle concentration and between 80 and 90 μm in particle size;

a solids disposition removal device operably connected to the desuperheater and configured to remove deposited solids from internal surfaces thereof; and a steam-particle separator connected to an outlet of the desuperheater and configured to receive the superheated steam output and remove therefrom solid particles exceeding 10 μm in size, including all of said solids particle content that measures between 80 and 90 μm in particle size, thereby achieving clean steam that is routed to a well pad of the SAGD injection or to another application through steam pipes, in which erosion from solid particles exceeding 10 μm in size is eliminated due to removal of said solid particles exceeding 10 μm in size by the steam-particle separator.

2. The system of claim 1 wherein the steam-particle separator has a solids disposal outlet through which solid particles are dispensed after separation from the superheated steam output of the desuperheater, said solids disposal outlet feeding a disposal conduit that is at least partially submerged in a fluid for cooling of said solids during travel thereof through a submerged portion of said disposal conduit.

3. The system of claim 1 wherein the convection tubes comprise first and second sets of convection tubes located respectively adjacent the flue gas outlet and the flue gas inlet of the convection section, and the superheater tubes are situated intermediately between said first and second sets of convection tubes in a flow direction of the flue gas pathway.

4. The system of claim 3 wherein the first set of convection tubes are situated upstream of the second set of convection tubes in relation to a direction of feed water flow through the convection tubes from the feed water inlet.

5. The system of claim 1 wherein the steam-water separator is a multi-stage separator for achieving a substantially dry steam.

6. The system of claim 5 wherein the multi-stage separator comprises a vessel with a primary cyclone separation stage and a secondary separation stage of chevron scrubbers mounted in an upper internal area of said vessel.

7. The system of claim 1 wherein the desuperheater comprises internal surface areas having a protective coating thereon to prevent disposition of solids on said surfaces.

8. The system of claim 7 wherein the desuperheater comprises an internal thermal sleeve obstructing outer walls of the desuperheater from exposure to the superheated steam and water droplets carried thereby, said protective coating being disposed on an interior surface of said internal thermal sleeve.

9. The system of claim 7 wherein said protective coating is a non-stick coating.

10. The system of claim 7 wherein said protective coating is a ceramic coating.

11. The system of claim 1 wherein the desuperheater is a Venturi-type desuperheater.

12. The system of claim 11 wherein the Venturi-type desuperheater is configured to provide a through-speed of between 70 m/s and 120 m/s at a Venturi throat of said desuperheater.

* * * * *